US008466805B2

(12) United States Patent
Waymire

(10) Patent No.: US 8,466,805 B2
(45) Date of Patent: Jun. 18, 2013

(54) EMERGENCY VEHICLE SIREN INDICATOR

(76) Inventor: William Michael Waymire, Indianapolis, IN (US)

( * ) Notice: Subject to any disclaimer, the term of this patent is extended or adjusted under 35 U.S.C. 154(b) by 361 days.

(21) Appl. No.: 12/959,773

(22) Filed: Dec. 3, 2010

(65) Prior Publication Data

US 2012/0139752 A1 Jun. 7, 2012

(51) Int. Cl.
*G08G 1/00* (2006.01)

(52) U.S. Cl.
USPC ..... 340/902; 340/903

(58) Field of Classification Search
USPC ..... 340/902, 903
See application file for complete search history.

(56) References Cited

U.S. PATENT DOCUMENTS

| | | | | |
|---|---|---|---|---|
| 6,160,493 | A | 12/2000 | Smith | |
| 6,917,306 | B2 | 7/2005 | Lilja | |
| 2001/0038344 | A1 | 11/2001 | Garcia | |
| 2002/0008635 | A1* | 1/2002 | Ewing et al. | 340/902 |
| 2003/0043056 | A1 | 3/2003 | Siegel | |
| 2003/0164775 | A1 | 9/2003 | Hutchison et al. | |
| 2003/0189497 | A1 | 10/2003 | Cho | |
| 2004/0036627 | A1 | 2/2004 | Knoski et al. | |
| 2004/0189490 | A1 | 9/2004 | Halishak | |
| 2006/0022843 | A1 | 2/2006 | Sommers | |
| 2006/0176190 | A1 | 8/2006 | Madison | |
| 2006/0227008 | A1 | 10/2006 | Bryant | |
| 2007/0139221 | A1 | 6/2007 | Falvey | |
| 2007/0216539 | A1 | 9/2007 | D'Antoni et al. | |
| 2007/0273551 | A1 | 11/2007 | Jacobs et al. | |
| 2008/0074286 | A1 | 3/2008 | Gill et al. | |
| 2008/0106435 | A1 | 5/2008 | Kirkpatrick | |
| 2009/0066538 | A1 | 3/2009 | Thomas et al. | |

* cited by examiner

*Primary Examiner* — Shirley Lu
(74) *Attorney, Agent, or Firm* — Keith Swedo

(57) ABSTRACT

An emergency vehicle includes a siren signal generator emitting an electronic siren signal. A siren loudspeaker is coupled to the siren signal generator and emits an audible siren sound in response to receiving the electronic siren signal. The loudspeaker has two inputs. An impedance detector is coupled to the two inputs of the loudspeaker and measures impedance across the two inputs of the loudspeaker. The impedance detector outputs a loudspeaker presence signal if the measured impedance is within a predetermined range. A siren signal detector is coupled to the siren signal generator and emits a siren signal presence signal in response to verifying that the electronic siren signal has a set of predetermined siren signal characteristics. Logic circuitry emits an enable signal in response to receiving both the loudspeaker presence signal and the siren signal presence signal. A radio frequency transmitter transmits a radio frequency notification signal in response to receiving the enable signal.

10 Claims, 5 Drawing Sheets

EMERGENCY VEHICLE SIREN INDICATOR

FIELD OF THE INVENTION

The present invention relates to a system for notifying nearby vehicle drivers of the presence of an emergency vehicle on an emergency response run.

BACKGROUND OF THE INVENTION

Emergency vehicles have an established method of warning vehicle operators and pedestrians of their approximate presence by utilizing flashing lights and an audible electronic warning siren while requesting the right of way for emergency response. Modern emergency vehicles using electronic warning sirens utilize one or more loudspeakers, also known as siren drivers, which are usually mounted to the front of the emergency vehicle. Through these speakers, the emergency vehicle may emit amplified S.A.E. approved emergency warning audible tones or industry accepted variations thereof. Well established examples of S.A.E. emergency warning tones include "wail" and "yelp", wherein the yelp may have the same waveform as the wail, but a higher frequency.

Due to modern practices of vehicle operators, warning signals from emergency vehicles often are not seen or heard in a timely manner. The use of personal electronics, in-vehicle entertainment systems, vehicle air conditioning and heating systems along with associated passenger distraction have steadily decreased the effectiveness of flashing emergency lights and the electronic warning siren of emergency vehicles. Automotive original equipment manufacturers (O.E.M.), manufacturers of emergency vehicle warning equipment and the public safety industry continue their search for an effective means of alerting operators of motor vehicles to the approximate presence of emergency vehicles that are responding to emergency calls. The implementation must be effective while also being easily recognizable and easily integrated into established practices, attitudes and methods used by operators of both emergency and non-emergency vehicles. The ease of implementation without drastic change to current attitudes and established practices is paramount.

It is known for an emergency vehicle to transmit a short-range radio frequency (RF) signal to nearby vehicles in order to inform the drivers' of those nearby vehicles that the emergency vehicle is on an emergency response run. The nearby vehicles may be required by law to pull over when an emergency vehicle on an emergency response run is approaching so as to not impede the emergency vehicle. Personnel within the emergency vehicle may flip a switch when the emergency response run is beginning in order to cause the RF signal to be transmitted.

A problem is that the switch may be inadvertently flipped when the vehicle is not on an emergency run, thereby causing the nearby vehicles receiving the resulting RF transmission to pull over or take other evasive action even though there is actually no nearby emergency vehicle on an emergency response run. For example, if the siren has been disconnected during service, or is otherwise not working, the switch could be inadvertently actuated and there would be no way for emergency vehicle personnel to know that the RF signal is being transmitted. Unknowingly and unnecessarily transmitting the RF signal could have deadly consequences for people in the receiving vehicles or in other vehicles in the area as receiving vehicles slow down or pull over to look for an emergency vehicle. Such inadvertent disruption of traffic flow may itself be a safety hazard that could cause traffic accidents.

It may be possible for the RF transmitter to be controlled by the same switch that controls the siren so that an inadvertent turning on of the RF transmitter would be accompanied by a simultaneous audible siren. The sound of the siren would prompt personnel to flip the switch back in order to turn off the siren as well as the RF transmitter. However, if the siren is inoperable or disconnected for some reason, such as during maintenance, it would be very easy for the switch to be inadvertently flipped on, thereby causing the RF signal to be transmitted without the emergency vehicle personnel receiving any notice that the RF transmitter has been inadvertently turned on, thereby causing a safety hazard.

What is needed in the art is an RF transmission system in an emergency vehicle that overcomes the disadvantages described above.

SUMMARY OF THE INVENTION

The present invention is directed to an RF transmission system in an emergency vehicle that may verify that an audible siren sound is being emitted from the vehicle before the RF signal is transmitted. Checking for an actual audible siren before transmitting the RF signal is an important safety precaution to prevent the RF signal from being transmitted without emergency vehicle personnel being aware of the RF transmission.

In one embodiment, the invention provides the automotive O.E.M. a means of indicating to a vehicle operator, by audible and/or visible indicators at the vehicle's dash panel, the approximate presence of an emergency vehicle. When beginning an emergency response, an emergency vehicle operator may activate the vehicle's electronic warning siren and warning lights by actuating one or more switches, pushbuttons and/or knobs. The switches, pushbuttons and/or knobs may be on the vehicle dashboard or on an aftermarket control box in the emergency vehicle's passenger compartment console, for example. The electronic warning siren may then emit an S.A.E. approved emergency warning tone or industry accepted variation thereof through one or more suitable siren speaker(s) and/or siren driver(s). In response to verifying that an audible emergency warning tone is being emitted by the electronic warning siren, siren speaker(s) and/or siren driver (s), an RF transmitter is activated and transmits an RF signal through an antenna that may be disposed at the highest point on the emergency vehicle. The transmitted RF signal may then be received by RF warning siren receivers disposed in vehicles within a radius of approximately between 350 and 450 feet of the transmitting emergency vehicle. The transmitted distance of the RF signal may be such that the audible emergency warning tone of the electronic emergency warning siren would be heard by vehicle operators in the approximate presence of the responding emergency vehicle. In response to receiving the RF signal, the receiving vehicle may notify the driver of the receiving vehicle that the RF signal has been received. The notification may be in the form of flashing lights on the dashboard of the vehicle, a visual indication on a heads up display, an audio tone or audible message, and/or a tactile stimulus such as a vibration of the driver's seat. In a specific embodiment, the driver of the receiving vehicle may be notified of the reception of the RF signal only if the receiving vehicle's ignition is on (e.g., in the run position) and/or the transmission shift lever is not in the park position.

In one embodiment, the invention provides a means of alerting vehicle operators who are within the approximate presence (e.g., less than 350-450 feet away) of an emergency vehicle that has a warning siren in audible operation. The invention may integrate a means of generating a radio frequency transmission that is physically located within an electronic warning siren package or form factor. The means of generating an RF transmission may be dependent upon, and may operate only in conjunction with, the active audible operation of the electronic warning siren tones.

The means of generating an RF transmission may detect a warning tone or tones (e.g., that produces a siren sound, such as a yelp or a wail) complying with the Society of Automotive Engineers (S.A.E.) standards (e.g., National Institute of Justice Guide 500-00 and National Institute of Justice Standard 0501.00) or an industry accepted variation thereof and that is being emitted by the emergency vehicle's electronic siren audio pre-amplifier output. Alternatively, or in addition, the means of generating an RF transmission may detect the presence of one or more properly functioning speakers and/or speaker drivers of proper electrical impedance that is/are operably connected to the electronic warning siren's audio output power amplifier. When the means of generating an RF transmission has detected the warning tone(s) and/or the properly configured speakers and/or speaker drivers, then it may be concluded that an audible siren sound is being emitted, and thus it is appropriate to also emit the RF signal that notifies nearby drivers of the presence of the emergency vehicle. Thus, when the warning tone(s) and/or the properly configured speakers and/or speaker drivers have been detected, then the RF signal may be transmitted for reception by vehicles that are within approximately 350-450 feet of the transmitting emergency vehicle.

In one embodiment, the arrangement of the invention does not require any changes to the operating protocols of existing siren systems, but rather is integrated into and only adds functionality to existing siren systems. The arrangement of the invention may function in unison with and dependent upon the audible function of an existing siren system. Thus, the arrangement of the invention may be considered to be a supplement to existing emergency vehicle warning practices.

In one embodiment, the emergency vehicle operator may activate the warning siren in the same way as in existing siren systems, such as by flipping a switch or pressing a pushbutton. Because the radio frequency transmission means may be incorporated into an existing siren system, no additional steps may be required of the emergency vehicle operator in order to commence transmission of the RF signal. Thus, the arrangement of the present invention may not require any additional training of emergency vehicle operators other than to make them aware that the RF transmission may be active only if the warning siren's amplifier output is audible and is emitting an S.A.E. approved emergency warning tone (e.g., wail or yelp) or industry accepted variation thereof through the siren speaker(s) and/or siren driver(s).

An advantage of the present invention is that the RF signal cannot be transmitted unless an audible siren sound is being emitted from the vehicle. Thus, the RF signal cannot be transmitted without personnel associated with the vehicle being aware of the RF transmission.

The invention comprises, in one embodiment, an emergency vehicle including a siren signal generator emitting an electronic siren signal. A siren loudspeaker is coupled to the siren signal generator and emits an audible siren sound in response to receiving the electronic siren signal. The loudspeaker has two inputs. An impedance detector is coupled to the two inputs of the loudspeaker and measures impedance across the two inputs of the loudspeaker. The impedance detector outputs a loudspeaker presence signal if the measured impedance is within a predetermined range. A siren signal detector is coupled to the siren signal generator and emits a siren signal presence signal in response to verifying that the electronic siren signal has a set of predetermined siren signal characteristics. Logic circuitry emits an enable signal in response to receiving both the loudspeaker presence signal and the siren signal presence signal. A radio frequency transmitter transmits a radio frequency notification signal in response to receiving the enable signal.

The invention comprises, in another embodiment, an emergency vehicle including a siren signal generator emitting an electronic siren signal. A siren loudspeaker is coupled to the siren signal generator and emits an audible siren sound in response to receiving the electronic siren signal. A siren activation sensor is coupled to the siren loudspeaker and emits a siren activation sensor signal in response to sensing that the siren loudspeaker is producing an audible siren sound. A radio frequency transmitter transmits a radio frequency notification signal to nearby vehicles in response to receiving the siren activation sensor signal.

The invention comprises, in yet another embodiment, a method of operating an emergency vehicle, including emitting an electronic siren signal by use of a siren signal generator. A siren loudspeaker is coupled to the siren signal generator. The electronic siren signal is received at the siren loudspeaker. An audible siren sound is emitted by use of the siren loudspeaker in response to the loudspeaker receiving the electronic siren signal. It is verified that the loudspeaker is configured to receive the electronic siren signal and that the electronic siren signal is being emitted by the siren signal generator. A radio frequency notification signal is transmitted to nearby vehicles. The transmitting step is dependent upon the verifying step.

Whilst the invention has been described above, it extends to any inventive combination of features set out above or in the following description. Although illustrative embodiments of the invention are described in detail herein with reference to the accompanying drawings, it is to be understood that the invention is not limited to these precise embodiments. As such, many modifications and variations will be apparent to practitioners skilled in the art. Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

BRIEF DESCRIPTION OF THE DRAWINGS

The invention may be performed in various ways, and, by way of example only, embodiments thereof will now be described, reference being made to the accompanying drawings in which.

DETAILED DESCRIPTION

Figure 1:
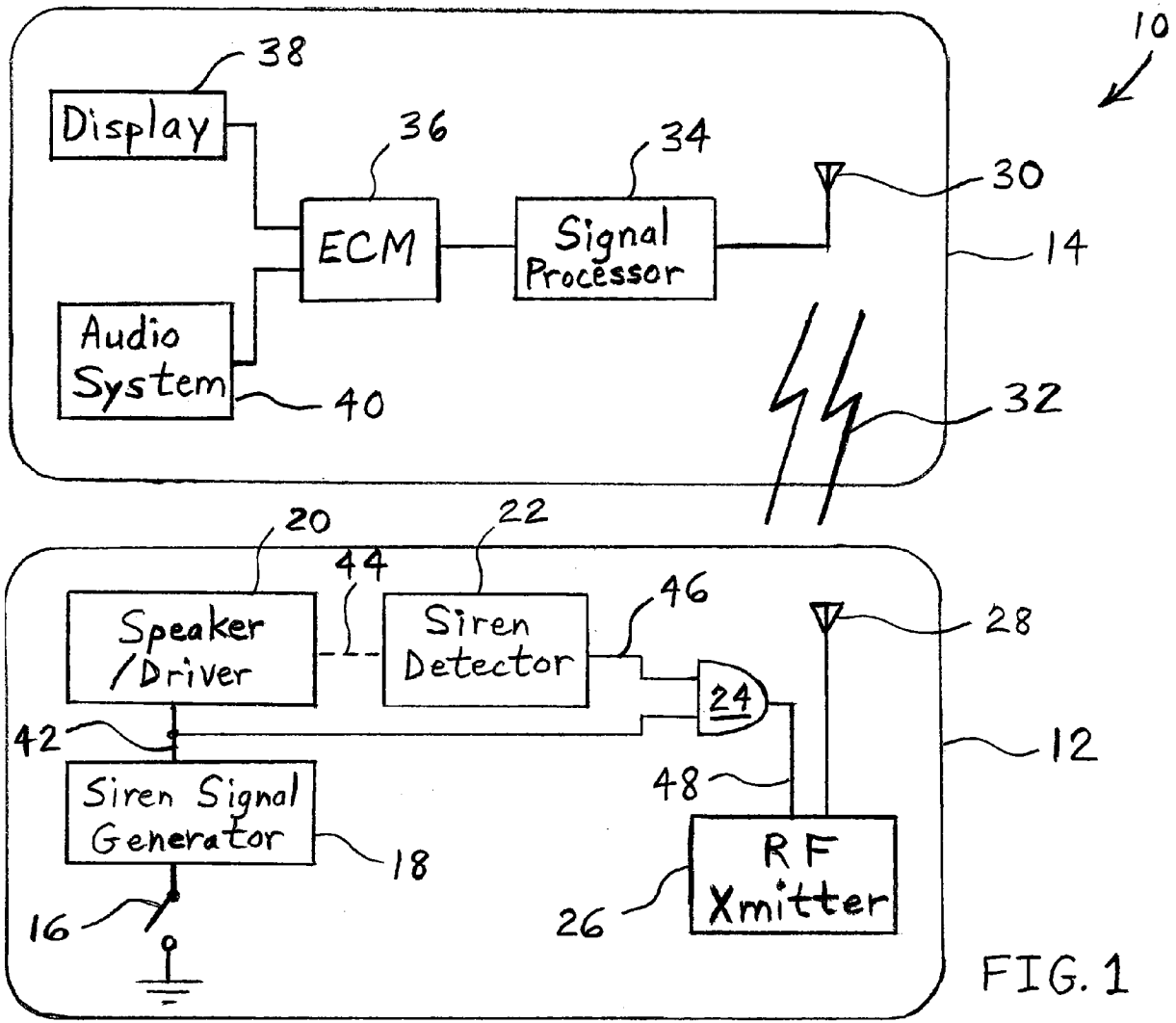
FIG. 1 is a block diagram of one embodiment of an emergency vehicle siren indicator arrangement of the present invention.

Referring to FIG. 1, one embodiment of an emergency vehicle proximity indicator arrangement 10 of the present invention is shown including an emergency vehicle 12 and another nearby vehicle 14. Although vehicle 14 is shown as being adjacent to vehicle 12, vehicle 14 may be up to about 400 feet away from vehicle 12 in one embodiment. In another embodiment, vehicle 14 may be up to a half mile away from vehicle 12.

Emergency vehicle 12 has an electronic RF warning siren including a switch 16, a siren signal generator 18, a speaker/driver 20, a siren detector 22, a logic circuit 24, an RF transmitter 26 and a transmitting antenna 28. All of the above-identified components of the electronic RF warning siren of vehicle 12, with the possible exceptions of speaker/driver 20 and antenna 28, may be packaged in a same enclosure or housing that may be installed in a dashboard (not shown) or center console (not shown) of vehicle 12. Antenna 28 may be installed at a relatively high point on vehicle 12, such as the roof of the passenger compartment (not shown) or the top edge of the front windshield (not shown). Antenna 28 may alternatively be a telescoping antenna installed in a rear quarter panel (not shown) of vehicle 12.

Nearby vehicle 14, which may be another emergency vehicle or a non-emergency vehicle, may include a receiving antenna 30 that is capable of receiving RF transmissions 32 from antenna 28 so long as vehicles 12, 14 are within about 400 feet of each other. However, this receiving range may vary depending upon the configurations of antennas 28, 30 as well as the level of transmission power of RF transmitter 26. Nearby vehicle 14 may also include a signal processor 34, an electronic control module (ECM) 36, a dashboard display 38 and an audio system 40. Alternatively, a body control module (BCM) may be used in place of ECM 36.

Switch 16, which may be manually actuatable by a passenger of vehicle 12, may be a rocker switch or a pushbutton switch, for example. The closing of switch 16 may apply power to or otherwise turn on siren signal generator 18, thereby causing generator 18 to output a siren signal on line 42. The siren signal may be received by a speaker/driver 20, which may emit an audible siren sound in response. Speaker/driver 20 may be installed on the roof of the passenger compartment or the front of vehicle 12, for example.

Siren detector 22 may be any device that is capable of confirming or verifying that speaker/driver 20 is operable and capable of emitting the audible siren sound, or is indeed currently emitting the audible siren sound. Detector 22 is indicated at 44 as being generally coupled to speaker/driver 20 because detector 22 may be operably coupled to speaker/driver 20 in a variety of different ways. For example, detector 22 may be hard-wired or otherwise physically connected to speaker/driver 20, magnetically coupled to speaker/driver 20, or merely positioned such that detector 22 may sense audible siren sounds being emitted by speaker/driver 20. If detector 22 does confirm or verify that speaker/driver 20 is operable and capable of emitting the audible siren sound, or is indeed currently emitting the audible siren sound, then detector 22 emits a high signal or a logic "1" signal on its output line 46.

One input of logic circuit 24 is connected to output line 46, and an other input of logic circuit 24 is connected to line 42. An output 48 of circuit 24 may be an input to RF transmitter 26. Logic circuit 24 may operate as a logic AND gate as schematically indicated in FIG. 1. That is, an output signal from circuit 24 may cause RF transmitter 26 to transmit an RF signal to nearby vehicles such as vehicle 14 if, and only if, a siren signal is being generated by generator 18 and siren detector 22 confirms or verifies that speaker/driver 20 is operable and capable of emitting the audible siren sound, or is indeed currently emitting the audible siren sound.

Signal processor 34 may receive the RF signal from emergency vehicle 12 via antenna 30. Signal processor 34 may receive a variety of stray RF signals via antenna 30 in addition to the RF signal from emergency vehicle 12. However, the RF signal transmitted by vehicle 12 may have one or more distinctive characteristics that enable signal processor 34 to recognize when a signal received by antenna 30 originates from an emergency vehicle such as vehicle 12. For example, all emergency vehicles may transmit RF signals with a same format or characteristic(s). In one embodiment, all emergency vehicles may transmit RF signals with a code identifying the emergency vehicle that is transmitting the signal.

If signal processor 34 determines that a recently received signal is an RF transmission from an emergency vehicle, then processor 34 transmits a corresponding signal to ECM 36. ECM 36 may then control audio system 40 to mute any audio that is currently playing on the speakers of vehicle 14. In addition, ECM 36 may control audio system 40 to play a spoken message on the speakers, such as "Caution, an emergency vehicle is in the area." ECM 36 may further control display 38 to provide a visible warning of the presence of the emergency vehicle to the driver of vehicle 14. For example, any lights on display 38 may flash on and off repeatedly in order to get the driver's attention.

Vehicle 12 may include all the components of vehicle 14 that are shown in FIG. 1 so that personnel within vehicle 12 may be notified of the presence of another emergency vehicle that is on an emergency run and that is therefore transmitting an RF signal. In order to prevent vehicle 12 from receiving its own RF transmission and interpreting the signal as being transmitted by another emergency vehicle, the RF signal may include a code that uniquely identifies the transmitting emergency vehicle. Signal processor 34 may read the code within the RF signal and inhibit the above-described operation of display 38 and/or audio system 40 if the code matches the code that uniquely identifies the vehicle in which signal processor 34 is disposed.

Figure 2:
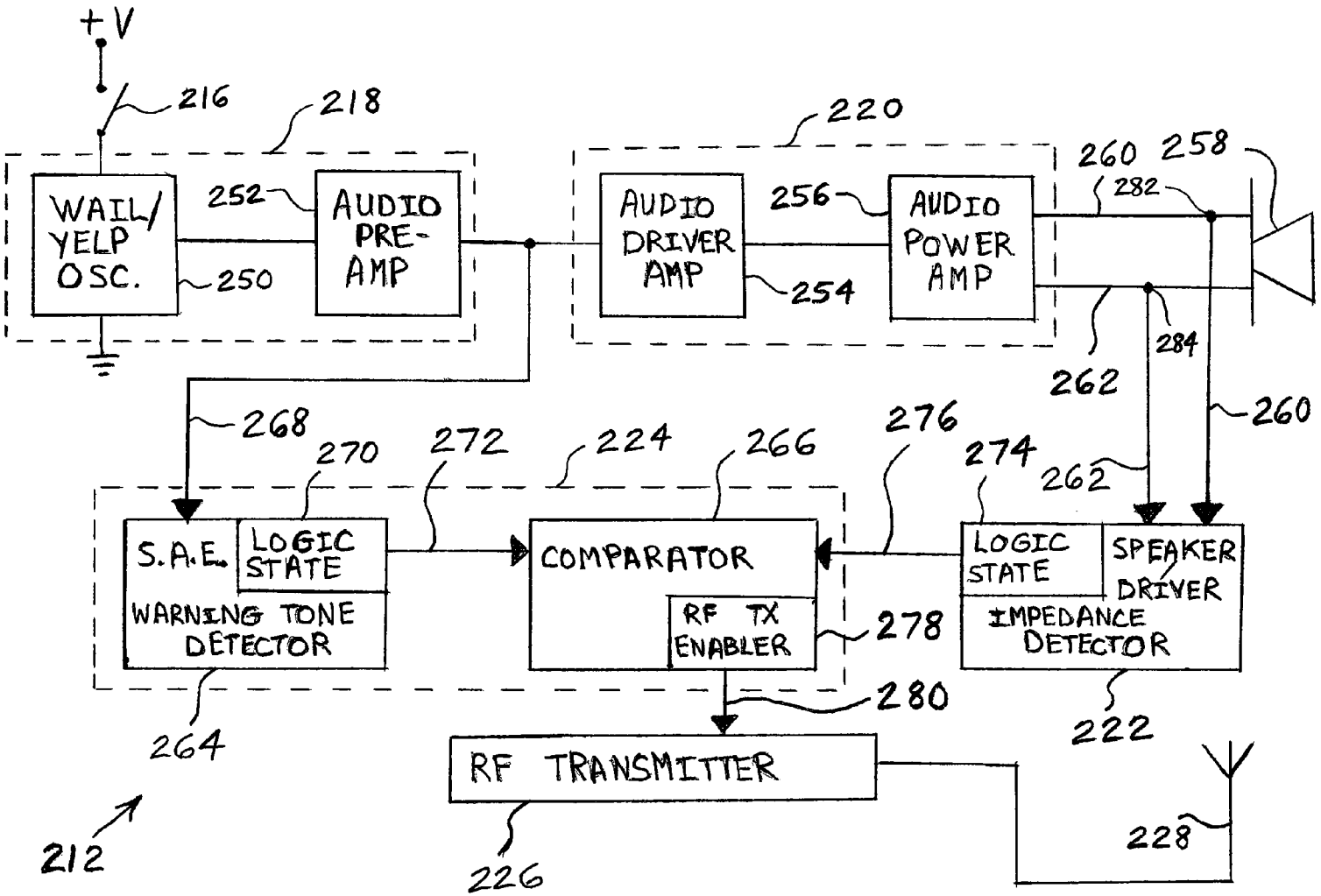
FIG. 2 is a block diagram of one embodiment of the emergency vehicle of FIG. 1.
Figure 3A:
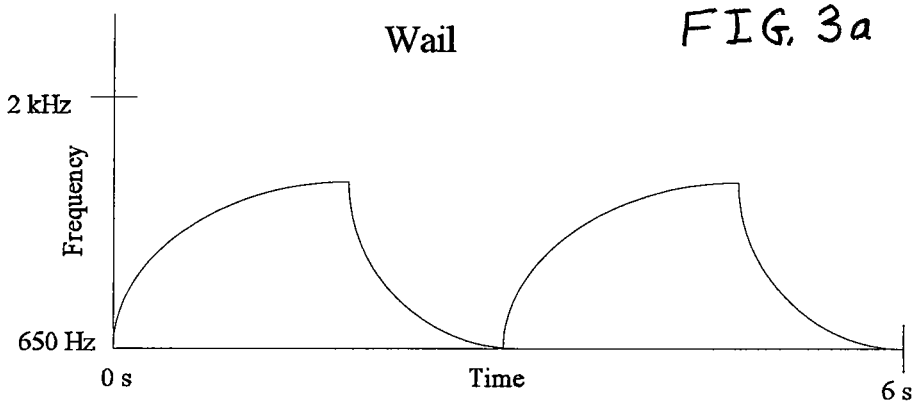
FIG. 3*a* is a plot of an example wail signal that may be transmitted by the wail/yelp oscillator of the emergency vehicle of FIG. 1.
Figure 3B:
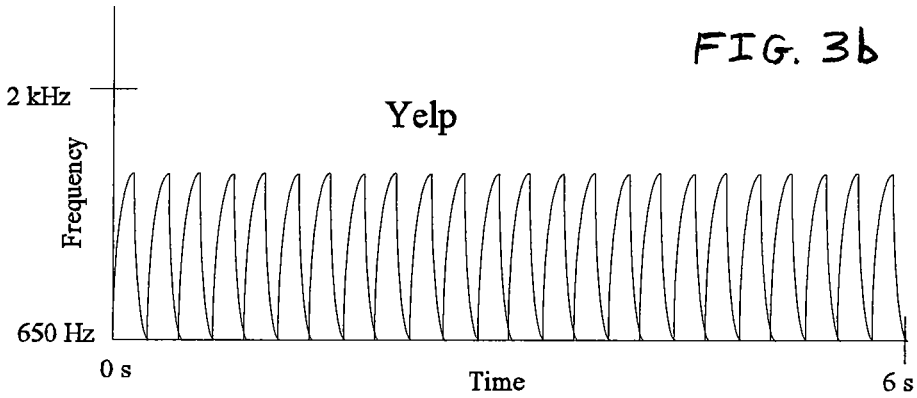
FIG. 3*b* is a plot of an example yelp signal that may be transmitted by the wail/yelp oscillator of the emergency vehicle of FIG. 1.

A specific embodiment of an emergency vehicle 212 of the present invention is shown in FIG. 2. Vehicle 212 includes a switch 216 that may be on a dashboard or center console of vehicle 212, for example. By actuating or otherwise closing switch 216, an operator of vehicle 212 may apply voltage to, and thereby turn on, a siren signal generator 218. Generator 218 includes a wail/yelp oscillator 250 that is configured to output a wail signal, an example of which is plotted in FIG. 3*a*, and/or a yelp signal, an example of which is plotted in FIG. 3*b*. In the example of FIG. 3*a*, the wail signal has a cycle rate of twenty cycles per minute; and in the example of FIG. 3*b*, the yelp signal has a cycle rate of 240 cycles per minute. Switch 216 may be a three-position switch having positions for OFF, Wail and Yelp, respectively. Alternatively, another switch (not shown) may be provided to enable the operator to switch between the wail and yelp signals. The output of oscillator 250 may be received by an audio preamplifier 252, which generally prepares the output signal of oscillator 250 for further amplification or processing.

The output of preamplifier 252, which is also the output of siren signal generator 218, is received by a loudspeaker driver 220 as well as by a logic circuit 224. Loudspeaker driver 220 includes an audio driver amplifier 254 that receives the output of preamplifier 252, and an audio power amplifier 256 that is the last amplification stage of driver 220. Driver 220 generally amplifies low-power audio signals (e.g., signals having frequencies between 20-20,000 Hz, which is the human range of hearing) from siren signal generator 218 to a level suitable for driving a loudspeaker 258. Power amplifier 256 has a positive output 260 and a negative output 262, each of which is received by speaker 258.

Logic circuit 224 includes a warning tone detector 264 and a comparator 266. Detector 264 is configured to verify that an electronic siren signal on line 268 has a set of predetermined siren signal characteristics. More particularly, detector 264 may verify the presence of an S.A.E. approved emergency warning tone (e.g., a wail signal or a yelp signal) or industry accepted variation thereof on input 268. If an S.A.E. approved emergency warning tone or industry accepted variation thereof is indeed present on input 268, then logic state circuitry 270 outputs a siren signal presence signal in the form of a logic "1" on line 272. On the other hand, if an S.A.E. approved emergency warning tone or industry accepted variation thereof is not present on input 268, then logic state circuitry 270 outputs a logic "0" on line 272.

Positive output 260 and negative output 262 from loudspeaker driver 220 are also received by a speaker/driver impedance detector 222. This speaker/driver impedance detector circuitry may monitor the audio power amplifier output and indicate whether a speaker(s)/driver(s) of proper electrical impedance are electrically connected. An indication of a properly connected speaker(s)/driver(s) may be sent from impedance detector 222 to comparator 266 through logic state circuitry 274 with a logical state indication. On the other hand, if a speaker(s)/driver(s) of proper electrical impedance are not connected, then an inverse logical state indication may be sent to comparator 266.

In one embodiment, speaker 258 has an impedance of about eleven ohms and loudspeaker driver 220 is rated for an output power of 100 Watts. If impedance detector 222 senses an impedance within a proper range across outputs 260, 262, then logic state circuitry 274 outputs a loudspeaker presence signal in the form of a logical "1" on line 276. On the other hand, if impedance detector 222 senses an impedance that is not within a proper range across outputs 260, 262, then logic state circuitry 274 outputs a logical "0" on line 276. If the impedance of speaker 258 is normally eleven ohms, then the proper range of impedance across outputs 260, 262 may be ten to twelve ohms, for example. In one embodiment, connections 282, 284 are as physically close as possible to the output terminals of audio power amplifier 256 in order to verify that there is no disconnection in-between amplifier 256 and speaker 258.

Upon installation and initialization of the system, when it is known that speaker 258 is properly connected, the impedance of speaker 258 may be measured by impedance detector 222. Impedance detector 222 may then automatically establish a proper range for the measured impedance across outputs 260, 262 as the measured impedance plus and minus a percentage of the measured impedance, or as the measured impedance plus and minus a fixed impedance value, such as +/− one ohm.

During use, S.A.E. emergency warning tone detector circuitry may monitor the output of the current siren audio pre-amplifier output to insure that an S.A.E. approved emergency warning tone, e.g., "wail" or "yelp" or industry accepted variation thereof is present. Indication of an S.A.E. approved emergency warning tone or industry accepted variation thereof may be sent to comparator 266 and RF transmitter enabler 278 through logic circuitry 270 with a logical state indication. Likewise, an inverse logical state indication may be sent when an S.A.E. approved emergency warning tone or industry accepted variation thereof is not detected.

Comparator 266 may receive input from both the S.A.E. approved emergency warning tone detector 264 and the speaker(s)/driver(s) impedance detector. Comparator 266 may compare the results of both inputs. When both inputs indicate logic of the affirmative, then RF enabler 278 may enable RF transmitter 226. More particularly, if comparator 266 receives simultaneously both a logical "1" from logic state circuitry 270, indicating that an S.A.E. approved emergency warning tone or industry accepted variation thereof is present on input 268, and a logical "1" from logic state circuitry 274, indicating that a loudspeaker is properly connected to outputs 260, 262, then a radio frequency transmitter enabler 278 may transmit an "enable signal" or an "activation signal" to RF transmitter 226 on line 280. Receipt of the activation signal may cause transmitter 226 to output an RF notification signal on antenna 228, and this signal from antenna 228 may be received by surrounding vehicles within a range of about 400 feet.

RF transmitter 226 may use an F.C.C. approved radio frequency, modulation technique and effective radiated power to achieve an RF field for an approximate 350-450 foot radius of transmitting emergency vehicle 212. The RF field may be such that the audible emergency warning tone of the electronic emergency warning siren would be heard by vehicle operators in the approximate presence of the responding emergency vehicle. In one embodiment, RF transmitter 226 may be enabled and activated only by comparator 266 and RF enabler circuitry 278.

The signal from antenna 228 may be received by antenna 30 (FIG. 1). Signal processor 34 may include RF circuitry tuned to and capable of receiving the F.C.C. approved modulated radio frequency transmitted by the electronic RF warning siren transmitter 226. Automotive O.E.M. body control module 36 may accept input from receiver state logic circuitry within signal processor 34. ECM 36 may control audible and visual indication to the vehicle operator accordingly.

Each of the components of vehicle 212 shown in FIG. 2, with the possible exceptions of antenna 228 and speaker 258, may be disposed within a same enclosure or housing. Thus, the system may be sold as a self-contained unit that may be installed with any antenna and speaker.

During installation of an aftermarket electronic RF warning siren unit into an emergency vehicle, the electronic RF warning siren may be synchronized with the emergency vehicle in which the unit is installed. An automotive original equipment manufacturer (O.E.M.) may define a process such that an installation technician may enable initializing, programming, or "learning" mode of the vehicle's RF warning siren receiver. The RF siren receiver may be synchronized to the electronic RF warning siren transmitter through a unique code that is included in the RF signal from the RF transmitter. Once the RF siren receiver learns the code of the transmitter installed in the same vehicle, the receiver is able to ignore RF signals from the transmitter installed in the same vehicle. On the other hand, when this electronic RF warning siren receiver receives a code that does not match the code of the transmitter installed in the same vehicle, then the receiver may communicate such reception to ECM 36. ECM 36 may then activate the vehicle's dashboard pulsating chime or other audible indication and a dash panel icon or other visual indicator.

In one particular embodiment, the dashboard pulsating chime is audible to the vehicle operator for a period of five to seven seconds and ceases; and the dash panel icon or other visual indicator flashes at a three to five Hertz rate and continues so long as the vehicle continues to receive the RF signal. In addition to warning non-emergency vehicle operators, this method of implementation may provide a means of warning the operators of other emergency vehicles that they also are within the approximate 350-450 foot radius of another emergency vehicle that has an electronic siren in audible operation.

The present invention has been described herein as verifying that an audible siren sound is being produced by an emergency vehicle before the emergency vehicle transmits an RF signal notifying nearby vehicles that the emergency vehicle is on an emergency response run. In the above-described embodiments, it is verified that an audible siren sound is being produced by checking that both a siren tone is being produced and a loud speaker is in place and connected. The connection and presence of the loudspeaker is verified by checking the impedance between the two outputs of the audio power amplifier. However, it is to be understood that it is within the scope of the invention for the presence and connection of the speaker to be checked in other ways. For example, the output AC current level of the audio power amplifier may be monitored. It is determined that the speaker is in place only if the current level is above a threshold value.

Figure 4:
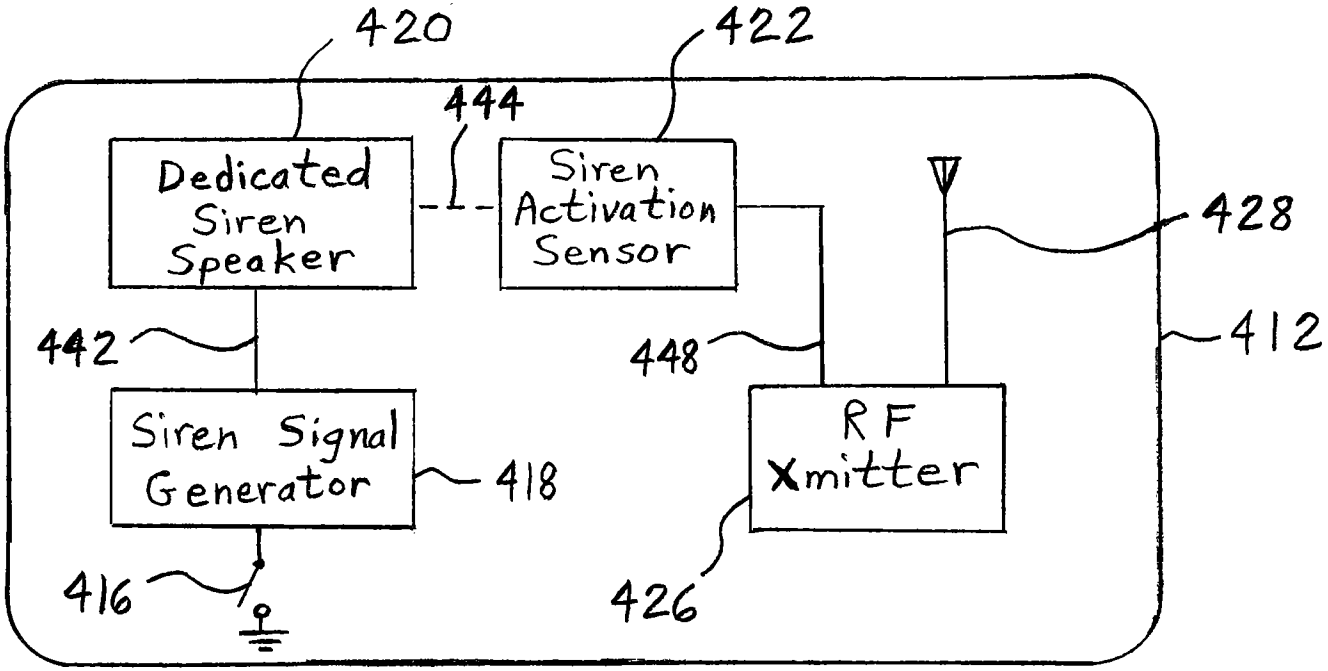
FIG. 4 is a block diagram of another embodiment of an emergency vehicle of the present invention.

In other possible embodiments, the presence of the audible siren sound may be verified more directly. Thus, if the audible siren sound emanates from a dedicated siren speaker that is not used for non-siren purposes, such as for public address speaking, then it may not be necessary to also verify the presence of the electronic siren tone signal, such as by warning tone detector 264. For example, FIG. 4 illustrates an emergency vehicle 412 including an electronic RF warning siren having a switch 416, a siren signal generator 418, a dedicated siren speaker 420, a siren activation sensor 422, an RF transmitter 426 and a transmitting antenna 428. All of the above-identified components of the electronic RF warning siren of vehicle 412, with the possible exceptions of speaker 420 and antenna 428, may be packaged in a same enclosure or housing that may be installed in a dashboard (not shown) or center console (not shown) of vehicle 412. Antenna 428 may be installed at a relatively high point on vehicle 412, such as the roof of the passenger compartment (not shown) or the top edge of the front windshield (not shown). Antenna 428 may alternatively be a telescoping antenna installed in a rear quarter panel (not shown) of vehicle 412.

Switch 416, which may be manually actuatable by a passenger of vehicle 412, may be a rocker switch or a pushbutton switch, for example. The closing of switch 416 may apply power to or otherwise turn on siren signal generator 418, thereby causing generator 418 to output a siren signal on line 442. The siren signal may be received by a dedicated siren speaker 420, which may emit an audible siren sound in response. Speaker 420 may have no other purpose than producing a siren sound such as a yelp, wail, or industry accepted variation thereof as opposed to also being usable as a public address speaker. Speaker 420 may be installed on the roof of the passenger compartment or the front of vehicle 412, for example.

Siren activation sensor 422 may be any device that is capable of sensing or verifying that dedicated speaker 420 is currently emitting the audible siren sound. Sensor 422 is indicated at 444 as being generally coupled to speaker 420 because sensor 422 may be operably coupled to speaker 420 in a variety of different ways. For example, sensor 422 may be hard-wired or otherwise physically connected to speaker 420, magnetically coupled to speaker 420, or merely positioned such that sensor 422 may sense audible siren sounds being emitted by speaker 420. If sensor 422 does confirm or verify that speaker 420 is currently emitting the audible siren sound, then sensor 422 emits a siren activation sensor signal on its output line 448. Receipt of the siren activation sensor signal on output line 448 by RF transmitter 426 may cause RF transmitter 426 to transmit an RF signal to nearby vehicles via antenna 428.

In one embodiment, siren activation sensor 422 includes a microphone that may be disposed near loudspeaker 420 in order to receive and sense the siren sounds being produced by loudspeaker 420. The output of the microphone may be processed by an audio processor within siren activation sensor 422 in order to verify that the speaker is producing a siren sound of sufficient loudness. If the processor determines that a siren sound of sufficient loudness is being produced, then a siren activation sensor signal is transmitted on output line 448, thereby causing RF transmitter 426 to transmit the RF notification signal via antenna 428.

In another embodiment, siren activation sensor 422 includes a vibration sensor that may be physically connected to loudspeaker 420 in order to sense the magnitude and frequency of vibration being produced by the loudspeaker. The output of the vibration sensor may be processed by a microprocessor within siren activation sensor 422 in order to verify that the magnitude and frequency of the vibration being produced by the speaker are consistent with the speaker producing a siren sound of sufficient loudness. If the microprocessor determines that a siren sound of sufficient loudness is being produced, then a siren activation sensor signal is transmitted on output line 448, thereby causing RF transmitter 426 to transmit the RF signal via antenna 428.

In yet another embodiment, siren activation sensor 422 includes a strain gauge that may be physically connected between a moving part of loudspeaker 420 and a fixed structure in order to sense the magnitude and frequency of movement of the moving part of the loudspeaker. The moving part of the speaker may be the speaker's diaphragm or voice coil, for example. The output of the strain gauge may be processed by a microprocessor within siren activation sensor 422 in order to verify that the magnitude and frequency of the forces exerted on the strain gauge by speaker 420 are consistent with the speaker producing a siren sound of sufficient loudness. If the microprocessor determines that the magnitude and frequency of the forces exerted on the strain gauge by the speaker are consistent with the speaker producing a siren sound of sufficient loudness, then a siren activation sensor signal is transmitted on output line 448, thereby causing RF transmitter 426 to transmit the RF signal via antenna 428.

Figure 5:
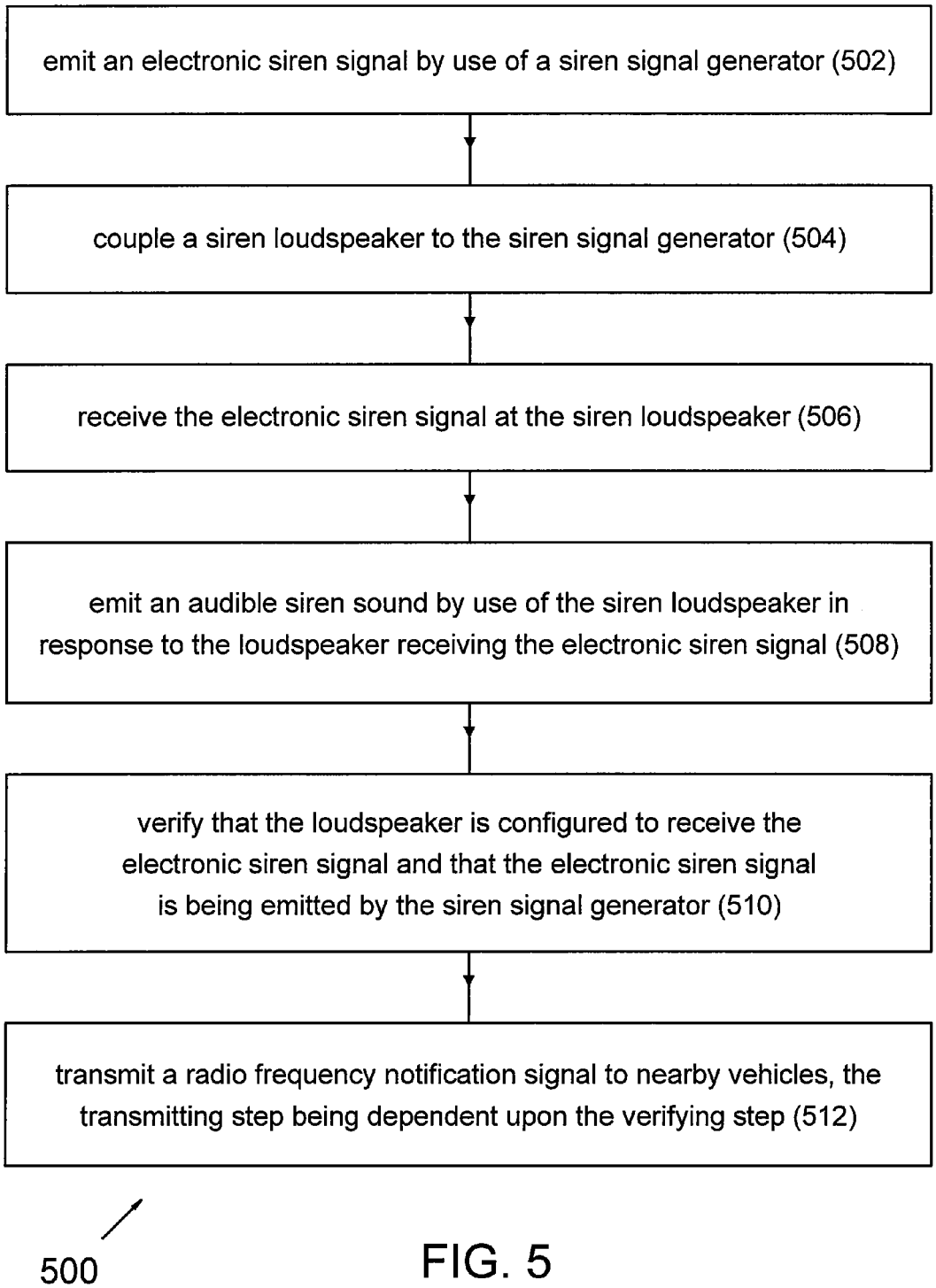
FIG. 5 is a flow chart of one embodiment of a method of the present invention for operating an emergency vehicle.

One embodiment of a method 500 of the present invention for operating an emergency vehicle is illustrated in FIG. 5. In a first step 502, an electronic siren signal is emitted by use of a siren signal generator. For example, each of siren signal generators 18, 218 and 418 may emit an electronic siren signal. An electronic siren signal may be in the form of a wail (FIG. 3*a*) or a yelp (FIG. 3*b*), or industry accepted variation thereof, for example.

In a next step 504, a siren loudspeaker is coupled to the siren signal generator. For example, speaker/driver 20 is coupled to siren signal generator 18; loudspeaker 258 is coupled to siren signal generator 218 via loudspeaker driver 220; and dedicated siren speaker 420 is coupled to siren signal generator 418.

Next, in step 506, the electronic siren signal is received at the siren loudspeaker. That is, each of speaker/driver 20, loudspeaker 258 and dedicated siren speaker 420 receives a respective electronic siren signal from siren signal generators 18, 218 and 418, respectively.

In step 508, an audible siren sound is emitted by use of the siren loudspeaker in response to the loudspeaker receiving the electronic siren signal. For example, each of speaker/driver 20, loudspeaker 258 and dedicated siren speaker 420 emits an audible siren sound in response to receiving a respective electronic siren signal from siren signal generators 18, 218 and 418, respectively.

In a next step 510, it is verified that the loudspeaker is configured to receive the electronic siren signal and that the electronic siren signal is being emitted by the siren signal generator. For example, within vehicle 12, siren detector 22 verifies that speaker/driver 20 is operable and capable of emitting the audible siren sound in response to receiving the electronic siren signal, or is indeed currently emitting the audible siren sound in response to receiving the electronic siren signal. Also, logic circuitry 24 verifies that the electronic siren signal is being emitted by siren signal generator 18.

As another example, within vehicle 212, impedance detector 222 measures the impedance across the two inputs of speaker 258 to thereby verify that speaker 258 is properly connected to the output of loudspeaker driver 220, from which the amplified electronic siren signal is transmitted. Also, warning tone detector 264 receives the electronic siren signal and thereby verifies that the signal is being emitted by siren signal generator 218.

As yet another example, within vehicle 412, siren activation sensor 422 verifies that dedicated siren speaker 420 is currently emitting an audible siren sound. Because speaker 420 may emit an audible siren sound only when both speaker 420 is receiving the electronic siren signal generated by generator 418, sensor 422 effectively verifies that a loudspeaker is configured to receive an electronic siren signal and that the electronic siren signal is being emitted by a siren signal generator.

In a final step 512, a radio frequency notification signal is transmitted to nearby vehicles. The transmitting is dependent upon the verifying step. As a first example, RF transmitter 26 transmits an RF notification signal only if siren detector 22 verifies that speaker/driver 20 is operable and capable of emitting the audible siren sound in response to receiving the electronic siren signal, or is indeed currently emitting the audible siren sound in response to receiving the electronic siren signal, and logic circuitry 24 verifies that the electronic siren signal is being emitted by siren signal generator 18.

As another example, RF transmitter 226 transmits an RF notification signal only if impedance detector 222 measures a proper impedance across the two inputs of speaker 258 to thereby verify that speaker 258 is properly connected to the output of loudspeaker driver 220, and warning tone detector 264 receives the electronic siren signal and thereby verifies that the signal is being emitted by siren signal generator 218.

As another example, RF transmitter 426 transmits an RF notification signal only if siren activation sensor 422 verifies that dedicated siren speaker 420 is currently emitting an audible siren sound, thereby effectively verifying that speaker 420 is configured to receive the electronic siren signal and that the electronic siren signal is being emitted by siren signal generator 418.

The speaker has been described herein as having "two inputs." It is to be understood that "two inputs" as used herein may mean two electrical conductors (+ terminal and – terminal) that carry a single electrical audio signal on a single channel.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

I claim:

1. An emergency vehicle comprising:

a siren signal generator configured to emit an electronic siren signal;

a siren loudspeaker coupled to the siren signal generator and configured to emit an audible siren sound in response to receiving the electronic siren signal, the loudspeaker having two inputs;

an impedance detector coupled to the two inputs of the loudspeaker and configured to:

measure impedance across the two inputs of the loudspeaker; and output a loudspeaker presence signal if the measured impedance is within a predetermined range;

a siren signal detector coupled to the siren signal generator and configured to emit a siren signal presence signal in response to verifying that the electronic siren signal has a set of predetermined siren signal characteristics;

logic circuitry configured to emit an enable signal in response to receiving both the loudspeaker presence signal and the siren signal presence signal; and a radio frequency transmitter configured to transmit a radio frequency notification signal in response to receiving the enable signal;

wherein the verifying step includes verifying that the electronic siren signal is a Society of Automotive Engineers (S.A.E.) approved or industry accepted variation siren signal.

2. A vehicle according to claim 1, wherein the electronic siren signal is a wail signal, yelp signal or industry accepted variation thereof.

3. A vehicle according to claim 1, wherein the set of predetermined siren signal characteristics includes characteristics of a wail signal, yelp signal, or industry accepted variation thereof.

4. A vehicle according to claim 1, wherein the set of predetermined siren signal characteristics includes a code identifying the siren signal as being a siren signal generated within an emergency vehicle.

5. A vehicle according to claim 3, wherein the set of predetermined siren signal characteristics includes a code uniquely identifying the emergency vehicle.

6. A vehicle according to claim 1, wherein the radio frequency notification signal has a reception range of less than about 450 feet.

7. A vehicle according to claim 1, further comprising a manually-actuatable switch configured to turn the siren signal generator on and off.

8. A method of operating an emergency vehicle, comprising the steps of:

emitting an electronic siren signal by use of a siren signal generator;

coupling a siren loudspeaker to the siren signal generator;

receiving the electronic siren signal at the siren loudspeaker;

emitting an audible siren sound by use of the siren loudspeaker in response to the loudspeaker receiving the electronic siren signal;

verifying that the loudspeaker is configured to receive the electronic siren signal and that the electronic siren signal is being emitted by the siren signal generator; and transmitting a radio frequency notification signal to nearby vehicles, the transmitting step being dependent upon the verifying step;

wherein the verifying step includes verifying that an impedance measured between two inputs of the loudspeaker is within a predetermined range;

wherein the verifying step includes verifying that the electronic siren signal is a Society of Automotive Engineers (S.A.E.) approved or industry accepted variation siren signal.

9. A method according to claim 8, wherein the radio frequency notification signal has a reception range of less than about 450 feet.

10. A method according to claim 8, comprising a further step of manually actuating a switch to thereby turn the siren signal generator on and off.

* * * * *